US010289033B2

(12) United States Patent
Torimaru et al.

(10) Patent No.: US 10,289,033 B2
(45) Date of Patent: May 14, 2019

(54) IMAGE FORMING APPARATUS

(71) Applicant: CANON KABUSHIKI KAISHA, Tokyo (JP)

(72) Inventors: Yuusuke Torimaru, Toride (JP); Dai Kanai, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/884,201

(22) Filed: Jan. 30, 2018

(65) Prior Publication Data

US 2018/0224773 A1 Aug. 9, 2018

(30) Foreign Application Priority Data

Feb. 6, 2017 (JP) ..... 2017-019916

(51) Int. Cl.

*G03G 15/00* (2006.01)
*G03G 15/16* (2006.01)
*G03G 21/00* (2006.01)

(52) U.S. Cl.

CPC ..... *G03G 15/161* (2013.01); *G03G 15/657* (2013.01); *G03G 21/00* (2013.01); *G03G 2221/00* (2013.01)

(58) Field of Classification Search

CPC . G03G 15/657; G03G 15/161; G03G 15/1675
See application file for complete search history.

(56) References Cited

U.S. PATENT DOCUMENTS 4,994,861 A * 2/1991 Brandon ..... G03G 15/6552 271/208
7,599,652 B2 * 10/2009 Takagami ..... G03G 15/657 399/315
2003/0202830 A1 * 10/2003 Oh ..... B65H 37/00 399/390
2006/0198668 A1 * 9/2006 Tsujita ..... G03G 15/6532 399/315
2008/0003025 A1 * 1/2008 Tsunoda ..... G03G 15/2028 399/328
2008/0095561 A1 * 4/2008 Tsujita ..... G03G 15/6535 399/398
2011/0103850 A1 * 5/2011 Watanabe ..... G03G 15/657 399/315

(Continued)

FOREIGN PATENT DOCUMENTS

JP 10-282798 A 10/1998
JP 2009-236999 A 10/2009

*Primary Examiner* — Sevan A Aydin
(74) *Attorney, Agent, or Firm* — Canon USA, Inc., IP Division

(57) ABSTRACT

An image forming apparatus includes a discharging device that discharges a sheet to which a toner image is transferred. The discharging device is disposed on a side opposite to a transfer surface of the sheet to which the toner image is transferred downstream from a nip portion between an intermediate transfer belt and an external secondary transfer roller in a sheet conveyance direction. The discharging device includes a grounded first discharging plate, and a grounded second discharging plate which is disposed downstream from the first discharging plate in the sheet conveyance direction at an angle different from an angle of the first discharging plate.

6 Claims, 9 Drawing Sheets

(56) References Cited

U.S. PATENT DOCUMENTS

| | | | | |
|---|---|---|---|---|
| 2011/0135350 | A1* | 6/2011 | Barton | G03G 15/2028 399/323 |
| 2012/0107025 | A1* | 5/2012 | Ohshika | G03G 15/167 399/315 |
| 2012/0189330 | A1* | 7/2012 | Kunimatsu | G03G 15/1665 399/44 |
| 2014/0064761 | A1* | 3/2014 | Hayashi | G03G 15/1675 399/66 |
| 2014/0233977 | A1* | 8/2014 | Gyotoku | G03G 21/20 399/96 |
| 2014/0233978 | A1* | 8/2014 | Nakai | G03G 15/657 399/96 |
| 2016/0147182 | A1* | 5/2016 | Yokoyama | G03G 15/1665 399/44 |
| 2018/0335730 | A1* | 11/2018 | Takayanagi | G03G 15/14 |

* cited by examiner

IMAGE FORMING APPARATUS

BACKGROUND

Field

The present disclosure relates to an image forming apparatus which uses a development device to form an image on a recording medium in an electrophotographic method, an electrostatic recording method, or the like.

Description of the Related Art

Conventionally, an image forming apparatus adopting an electrophotographic method is applied widely as a copying machine, a printer, a plotter, a facsimile, and a multifunction machine having a plurality of functions of these machines and devices. Such a kind of image forming apparatus, which uses a developer (two-component developer) mainly containing a (nonmagnetic) toner and a (magnetic) carrier to develop an electrostatic image formed on a photosensitive body, is widely used. In such an image forming apparatus, for example, a toner image born by a photosensitive drum is transferred from the photosensitive drum to a sheet by applying a transfer voltage to a transfer portion which is a nip portion between the photosensitive drum and a transfer roller. For example, in a case where the toner has a negative electrostatic property, a positive voltage is applied from the transfer roller to the photosensitive drum. Therefore, positive charges might excessively move to the sheet while the sheet passes through the transfer portion. This might deteriorate an ability of the sheet to be separated from the photosensitive drum.

In order to solve this issue, Japanese Patent Application Laid-Open No. H10-282798 discusses, as the image forming apparatus, an apparatus in which a discharging unit is disposed downstream in a sheet conveyance direction in the transfer portion (hereinafter, downstream). The discharging unit eliminates excessive positive charges by applying a negative voltage downstream of the sheet in the transfer portion. This heightens the ability of the sheet to be separated from the photosensitive drum. Further, the discharging unit is required to heighten the separating ability and, at the same time, to prevent image fluctuation caused by flowing of some ions generated from the discharging unit into the transfer portion during image formation. Therefore, this discharging unit includes a first needle-shaped protrusion and a second needle-shaped protrusion. Excessive positive charges of the sheet is widely discharged in a manner that some ions generated from the discharging unit are prevented from flowing into the transfer portion by applying a negative voltage, which is equal in polarity with the toner, to these needle-shaped protrusions.

In recent years, some image forming apparatuses provide multiple steps of process speeds in order to cope with a variety of recording media and productivity. A study conducted by the inventors of this application revealed that a charging polarity of a sheet became positive or negative depending on the process speed (see FIG. 6A). Further, the study revealed that the charging polarity of a sheet changes depending not only on the process speed but also on a resistance value of a sheet and a transfer bias.

In the above-described image forming apparatus discussed in Japanese Patent Application Laid-Open No. H10-282798, however, the discharging unit eliminates excessive positive charges by applying a negative voltage downstream of the sheet in the transfer portion. For this reason, if a sheet is negatively charged, insufficient discharging which cannot produce a discharging effect is performed. Consequently, the excessive negative charges of the sheet is discharged between members having different electric potentials on the downstream side in the transfer portion. This might cause image fluctuation.

SUMMARY

The present disclosure is directed to an image forming apparatus that has a simple configuration and can perform discharging in any of cases where a charging property of a sheet obtained by transfer is positive and negative.

According to an aspect of the present disclosure, an image forming apparatus includes an intermediate transfer belt configured to carry a toner image, a first transfer roller being in contact with an outer circumferential surface of the intermediate transfer belt and configured to transfer the toner image carried by the intermediate transfer belt to a recording medium at a transfer portion, a second transfer roller being in contact with an inner circumferential surface of the intermediate transfer belt and configured to form the transfer portion, and a discharging device being disposed downstream from the transfer portion in a recording medium conveyance direction and configured to discharge an electric charge of a surface of the recording medium while the recording medium passes through the transfer portion, the surface of the recording medium being opposite to a surface on which the toner image is transferred. The discharging device includes a first discharging unit configured to discharge the recording medium, the first discharging unit being disposed and extending in a widthwise direction orthogonal to the recording medium conveyance direction, a second discharging unit configured to discharge the recording medium, the second discharging unit being disposed downstream from the first discharging unit in the recording medium conveyance direction and extending in the widthwise direction orthogonal to the recording medium conveyance direction, and a regulating unit configured to regulate contact of the recording medium with leading edges of the first and second discharging units, the regulating unit protruding toward the recording medium conveyance path to exceed the leading edges of the first and second discharging units. The first discharging unit is disposed so that the leading edge thereof close to the recording medium conveyance path faces upstream in the recording medium conveyance direction, and in a cross section orthogonal to a rotational axis of the first transfer roller, an angle between a reference line and the first discharging unit is in a range from 40° or more to 80° or less and an angle between the reference line and the second discharging unit is in a range of 30° or less, the reference line connecting a rotational center of the first transfer roller and a rotational center of the second transfer roller, and wherein both the first discharging unit and the second discharging unit are mounted so as to be grounded.

Further features will become apparent from the following description of exemplary embodiments with reference to the attached drawings.

DESCRIPTION OF THE EMBODIMENTS

An exemplary embodiment will be described in detail below with reference to FIG. 1 to FIG. 5. In the present exemplary embodiment, as one example of an image forming apparatus 1, a tandem full-color printer will be described. Aspects of the present disclosure are not limited to the image forming apparatus 1 of the tandem type, and may be an image forming apparatus of another type. Further, aspects of the present disclosure are not limited to the full-color image forming apparatus, and may be monochrome or mono color image forming apparatuses. Alternatively, aspects of the present disclosure can be exploited for various uses, for example, printers, various printing machines, copying machines, facsimiles (FAX), and multifunction machines.

Figure 1:
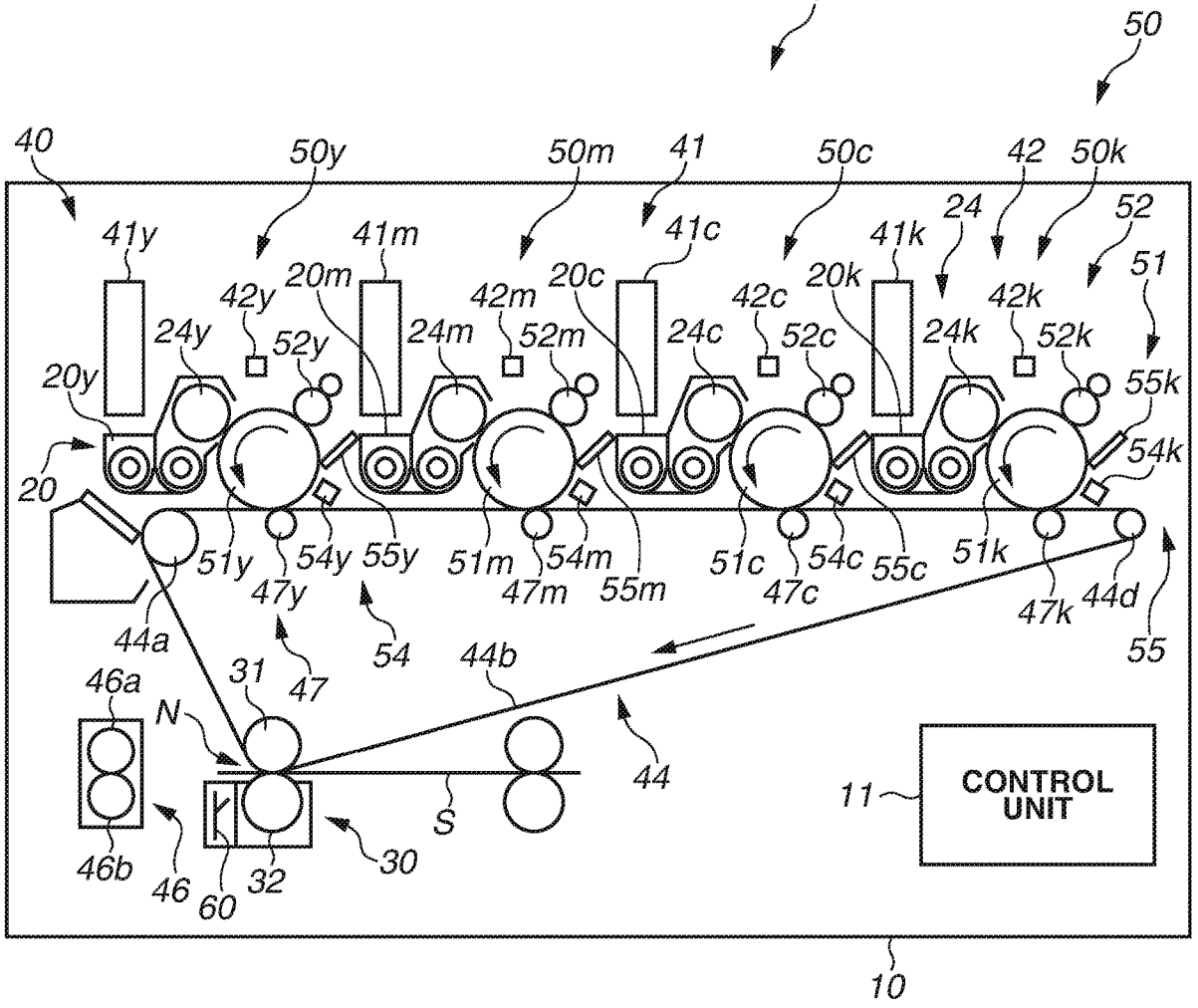
FIG. 1 is a cross-sectional view illustrating a schematic configuration of an image forming apparatus according to an exemplary embodiment.

As illustrated in FIG. 1, the image forming apparatus 1 includes an apparatus main body 10, a sheet feeder unit (not illustrated), an image forming portion 40, a sheet ejection portion (not illustrated), and a control unit 11. The image forming apparatus 1 can form a four-full-color image on a recording medium in accordance with an image signal from a document reader (not illustrated), a host device such as a personal computer, or an external device such as a digital camera or a smartphone. Specific examples of a sheet S as a recording medium on which a toner image is formed are plain paper, a synthetic resin sheet which is a plain paper substitute, a cardboard, and a sheet for an overhead projector.

The image forming portion 40 can form an image on the sheet S fed from the sheet feeding unit, based on image information. The image forming portion 40 includes image forming units 50*y*, 50*m*, 50*c*, and 50*k*, toner bottles 41*y*, 41*m*, 41*c*, and 41*k*, exposure devices 42*y*, 42*m*, 42*c*, and 42*k*, an intermediate transfer unit 44, a secondary transfer unit 30, and a fixing portion 46. The image forming apparatus 1 according to the present exemplary embodiment supports full color printing, and the image forming units 50*y*, 50*m*, 50*c*, and 50*k* having a configuration similar to each other are provided separately for four colors including yellow (y), magenta (m), cyan (c), and black (k). For this reason, in FIG. 1, the components for the four colors are designated by the same reference numeral to which color identifiers are appended. However, in this specification, the reference numerals without color identifiers are also used.

The image forming unit 50 includes a photosensitive drum 51 that moves while carrying a toner image, a charging roller 52, a development device 20, a pre-exposure device 54, and a cleaning blade 55. The image forming unit 50 is unitized as a process cartridge, and is configured to be detachable from the apparatus main body 10. In the present exemplary embodiment, a negatively charged toner with an average particle diameter of 5.5 μm is used as a toner, and a magnetic carrier having a saturation magnetization of 0.205 $Am^2/m^3$ and an average particle diameter of 35 μm is used as a carrier. Further, a substance obtained by mixing the toner and the carrier at a weight ratio of 6:94 is used as a developer.

The photosensitive drum 51, which is rotatable, carries an electrostatic image to be used for image formation. In the present exemplary embodiment, the photosensitive drum 51 is a negatively charging organic photosensitive body (OPC) which has an outside diameter of 30 mm, and is rotationally driven by a motor (not illustrated) in a direction of an arrow at a process speed (circumferential speed) of 240 mm/sec, for example. The photosensitive drum 51 includes an aluminum cylinder as a base member, and three layers as a surface layer on a surface of the aluminum cylinder. The three layers are an undercoat layer, an optical charge generation layer, and a charge transport layer which are laminated in this order from the surface of the aluminum cylinder.

The charging roller 52 is a rubber roller which comes in contact with the surface of the photosensitive drum 51 in a length of 320 mm, for example, and is driven to be rotated. The charging roller 52 uniformly charges the surface of the photosensitive drum 51. The charging roller 52 is connected with a charging bias power source. The charging bias power source applies a direct-current voltage as a charging bias to the charging roller 52 to charge the photosensitive drum 51 via the charging roller 52.

The exposure device 42, which is a laser scanner, emits a laser beam in accordance with image information about separated colors output from the control unit 11. The exposure device 42 enables formation of an image with a length of 305 mm in a lengthwise direction. Upon receiving a development bias, the development device 20 develops an electrostatic image formed on the photosensitive drum 51 using toner.

The development device 20 includes a development sleeve 24. The development device 20 stores the developer supplied from the toner bottle 41 and develops the electrostatic image formed on the photosensitive drum 51. The development sleeve 24 carries the developer having a nonmagnetic toner and a magnetic carrier, and conveys the developer to a development area facing the photosensitive drum 51. The development sleeve 24 coats a range of 310 mm in the lengthwise direction with the developer. The development sleeve 24 is made of a nonmagnetic material such as aluminum or nonmagnetic stainless, and in the present exemplary embodiment, it is made of aluminum. A roller-shaped magnet roller is fixed inside the development sleeve 24 so as not to rotate with respect to a developer container.

The toner image developed on the photosensitive drum 51 is primarily transferred to the intermediate transfer unit 44. The surface of the photosensitive drum 51 after the primary transfer is discharged by the pre-exposure device 54. The cleaning blade 55 is of a counter blade type, and is in contact with the photosensitive drum 51 with a predetermined pressing force. After the primary transfer, toner, which has not been transferred to the intermediate transfer unit 44 and remains on the photosensitive drum 51, is removed by the cleaning blade 55 provided such that the cleaning blade 55 comes in contact with the photosensitive drum 51, for the purpose of a next image forming step.

The intermediate transfer unit 44 includes a plurality of rollers, such as a drive roller 44*a*, a driven roller 44*d*, primary transfer rollers 47*y*, 47*m*, 47*c*, and 47*k*, and an intermediate transfer belt (image carrier) 44*b* which is provided over these rollers and moves while carrying a toner image. The primary transfer rollers 47*y*, 47*m*, 47*c*, and 47*k* are disposed to face the photosensitive drums 51*y*, 51*m*, 51*c*, and 51*k*, respectively, and are in contact with the intermediate transfer belt 44*b* to primarily transfer the toner image on the photosensitive drum 51 to the intermediate transfer belt 44*b* which is another image carrier.

The intermediate transfer belt 44*b* comes in contact with the photosensitive drum 51 so that a first primary transfer portion is formed between the intermediate transfer belt 44*b* and the photosensitive drum 51. Application of a primary transfer bias causes the primary transfer portion to primarily transfer the toner image formed on the photosensitive drum 51. The primary transfer roller 47 applies a primary transfer bias having positive polarity to the intermediate transfer belt 44*b*. As a result, the toner images each having negative polarity on the photosensitive drums 51 is successively transferred to the intermediate transfer belt 44*b* in a multiplex manner. That is, in the present exemplary embodiment, the image carrier is the intermediate transfer belt 44*b* to which a toner images formed on the photosensitive drums 51 which rotate while carrying the toner images are transferred. As the intermediate transfer belt 44*b*, a semiconductive polyimide resin having volume resistivity ρv of $1\times10^{6}$ to $10^{11}$ Ω·m is used.

The secondary transfer unit 30 includes an internal secondary transfer roller 31, an external secondary transfer roller (transfer unit) 32, and a discharging device (a discharging unit) 60. Applying a secondary transfer bias having positive polarity (transfer voltage) to a nip portion N between the external secondary transfer roller 32 and the intermediate transfer belt 44*b* causes the external secondary transfer roller 32 to secondarily transfer the toner image formed on the intermediate transfer belt 44*b* to the sheet S. Details of the secondary transfer unit 30 will be described below.

The fixing portion 46 includes a fixing roller 46*a* and a pressing roller 46*b*. The sheet S is nipped between the fixing roller 46*a* and the pressing roller 46*b* and is conveyed. As a result, the toner image transferred to the sheet S is heated and pressed to be fixed to the sheet S. After the fixing, the sheet discharge unit feeds the sheet S conveyed from a sheet discharge path and discharges the sheet S from a sheet discharge port to stack the sheet S on a discharge tray.

The control unit 11 is a computer, and includes, for example, a central processing unit (CPU), a read only memory (ROM) that stores programs for controlling the respective devices, a random access memory (RAM) that temporarily stores data, and an input/output circuit that externally inputs/outputs signals. The CPU is a microprocessor that entirely controls the image forming apparatus 1, and a main body of a system controller. The CPU is connected to the sheet feeding unit, the image forming portion 40, and the sheet discharge unit via the input/output circuit to exchange signals with the respective devices and control operations. The ROM stores an image formation control sequence for forming an image on the sheet S.

An image forming operation in the image forming apparatus 1 having such a configuration will be described below.

When the image forming operation starts, first the photosensitive drum 51 rotates and its surface is charged by the charging roller 52. The exposure device 42 emits a laser beam to the photosensitive drum 51 based on image information, and an electrostatic latent image is formed on the surface of the photosensitive drum 51. Adhesion of a toner to the electrostatic latent image causes the electrostatic latent image to be developed, and visualized as a toner image. Then, The developed toner image is transferred to the intermediate transfer belt 44*b*.

Meanwhile, the sheet S is supplied in parallel with the above described operation for forming a toner image, and is conveyed to the secondary transfer unit 30 via a conveyance path in synchronized timing with the toner image an the intermediate transfer belt 44*b*. Further, the image is transferred from the intermediate transfer belt 44*b* to the sheet S. Then, the sheet S is conveyed to the fixing portion 46, and an unfixed toner image is heated and pressed to be fixed to the surface of the sheet S. The sheet S is then discharged from the apparatus main body 10.

The secondary transfer unit 30 in the image forming apparatus 1 according to the present exemplary embodiment will be described in detail below with reference to FIGS. 2 to 5.

Figure 2:
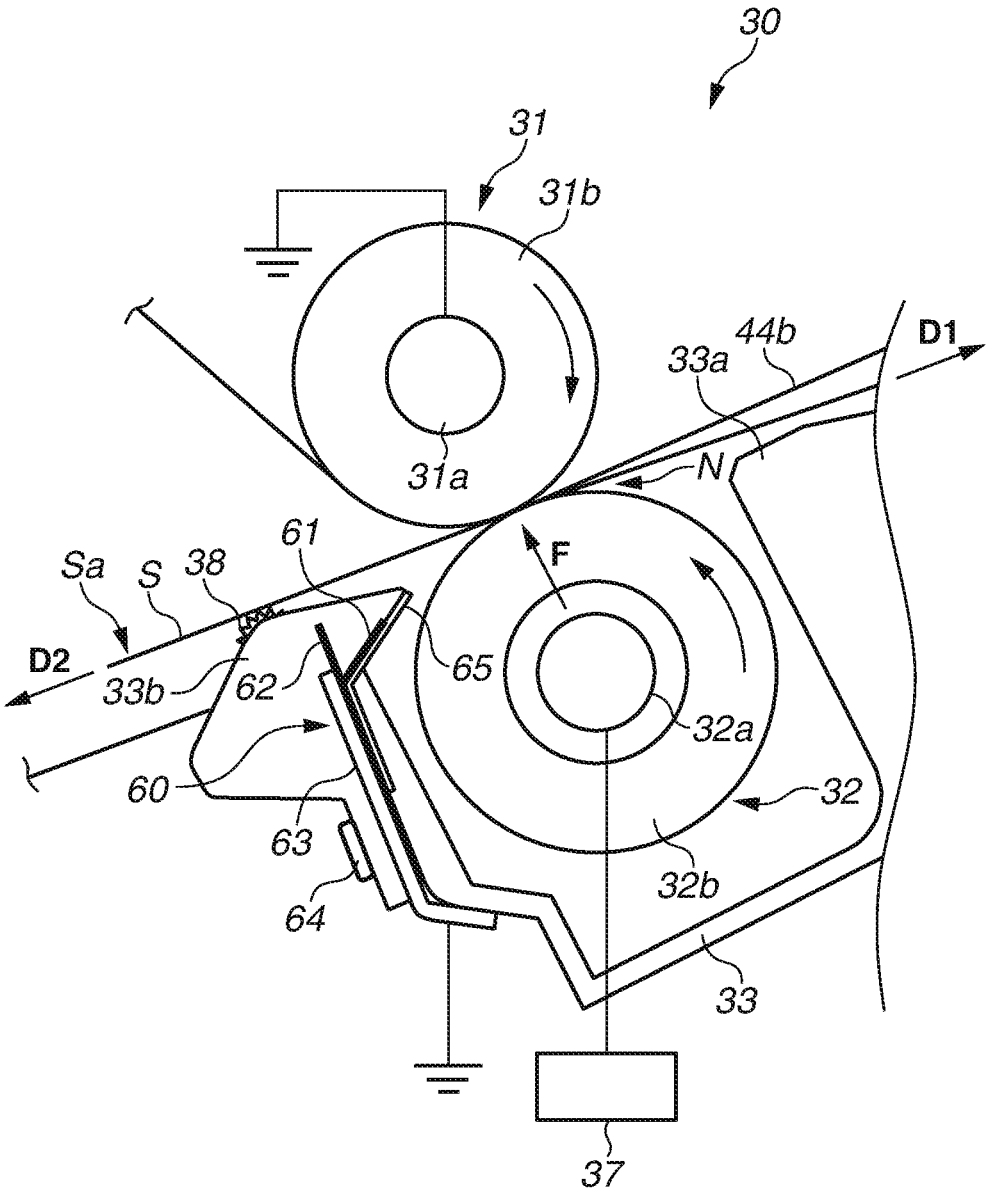
FIG. 2 is a cross-sectional view illustrating a secondary transfer unit of the image forming apparatus according to the exemplary embodiment.

As illustrated in FIG. 2, the internal secondary transfer roller 31 serves as a semiconductive roller including a core metal 31*a* and an elastic layer 31*b* that is made of electro conductive rubber and is provided around the core metal 31*a*. The core metal 31*a* has an outside diameter of 16 mm. The elastic layer 31*b* is formed by dispersing electro conductive carbons throughout ethylene-propylene diene monomer (EPDM) rubber and has an outside diameter of 20 mm. A resistance value of the internal secondary transfer roller 31 is about $1\times10$ to $10^{5}$Ω under an environment where a temperature is 23° C. and a relative humidity is 50% RH when an applied voltage is 10 V. The core metal 31*a* of the internal secondary transfer roller 31 is connected to a ground potential.

The external secondary transfer roller 32 is in contact with the intermediate transfer belt 44*b* to form the nip portion N between the external secondary transfer roller 32 and the intermediate transfer belt 44*b*. Application of a secondary transfer bias to the nip portion N causes a toner image primarily transferred to the intermediate transfer belt 44*b* to be secondarily transferred to the sheet S. The external secondary transfer roller 32 serves as a semiconductive roller including a core metal 32*a*, and an elastic layer 32*b* that is made of electro conductive rubber and is provided around the core metal 32*a*. The core metal 32*a* has an outside diameter of 16 mm. The elastic layer 32*b* is formed by mixing an ion conductive agent into nitril-butadiene rubber (NBR) or EPDM rubber and has an outside diameter of 24 mm.

Figure 3:
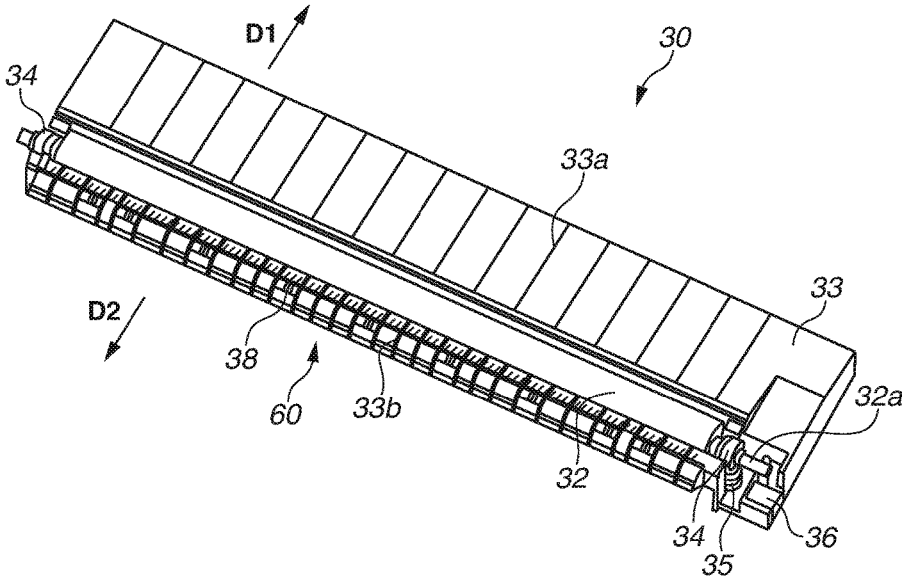
FIG. 3 is a perspective view illustrating a transfer roller holder of the secondary transfer unit according to the exemplary embodiment.

As illustrated in FIG. 3, the external secondary transfer roller 32 is supported rotatably by a transfer roller holder 33.

The transfer roller holder 33 includes bearings 34 which rotatably support the core metal 32*a* on both ends of the external secondary transfer roller 32, upstream guide ribs 33*a*, and downstream guide ribs 33*b*. The upstream guide ribs 33*a* are formed on an upstream side D1 from the external secondary transfer roller 32 in a sheet conveyance direction, and guide the sheet S before being subject to the secondary transfer to the nip portion N. The downstream guide ribs 33*b* are formed on a downstream side D2 from the external secondary transfer roller 32 in the sheet conveyance direction, and guide the sheet S which has been subject to the secondary transfer from the nip portion N.

Figure 4:
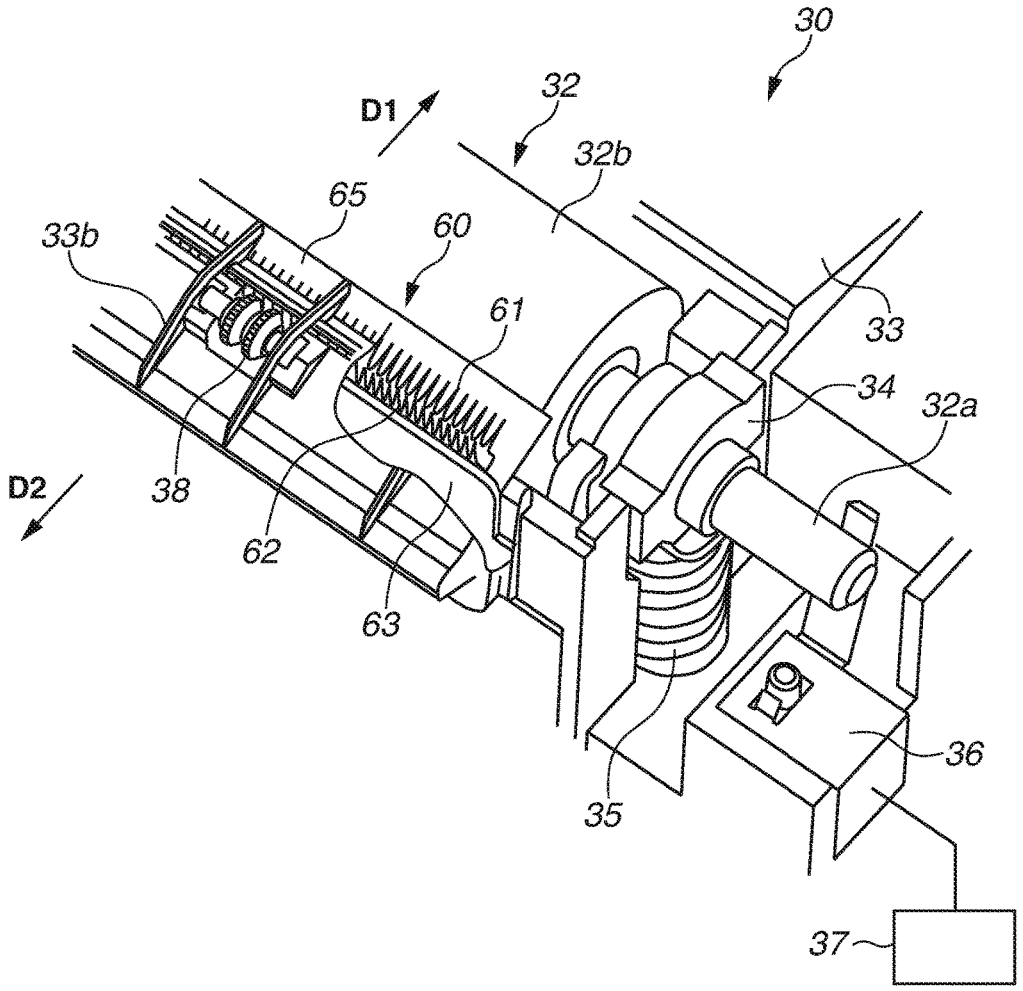
FIG. 4 is a perspective view illustrating a main part of the transfer roller holder of the secondary transfer unit according to the exemplary embodiment.

As illustrated in FIG. 4, driven rolling members 38, which guide the sheet S in cooperation with the downstream guide ribs 33*b*, are provided between some of the adjacent downstream guide ribs 33*b*. Further, the transfer roller holder 33 includes an urging spring 35 and a contact spring 36. The urging spring 35, which is a helical compression spring, urges the bearings 34 toward the intermediate transfer belt 44*b* (in FIG. 2, an arrow F). Therefore, the urging spring 35 urges both the ends of the core metal 32*a* in the external secondary transfer roller 32 toward the intermediate transfer belt 44*b*. Thus, the external secondary transfer roller 32 is brought in pressure-contact with the internal secondary transfer roller 31 via the intermediate transfer belt 44*b*. The nip portion N for secondary transfer is formed between the intermediate transfer belt 44*b* and the external secondary transfer roller 32 (see FIG. 2).

The contact spring 36 is brought into contact with the core metal 32*a* of the external secondary transfer roller 32 by a metal leaf spring. A secondary transfer power source (transfer power source) 37 is connected to the contact spring 36. That is, the secondary transfer power source 37 is connected to the core metal 32*a* of the external secondary transfer roller 32 via the contact spring 36, and applies a secondary transfer bias to the external secondary transfer roller 32. The application of the secondary transfer bias causes the toner image which is charged to have negative polarity and is carried by the intermediate transfer belt 44*b* to be secondarily transferred to the sheet S which passes through the nip portion N. Prior to image formation, the secondary transfer bias is set by applying a voltage to the external secondary transfer roller 32, and, for example, is a direct-current voltage of +2.3 kV, which has positive polarity and is controlled at a constant voltage.

The discharging device 60 is, as illustrated in FIG. 2, provided to the downstream side D2 from the external secondary transfer roller 32 of the transfer roller holder 33 in the sheet conveyance direction. That is, the discharging device 60 is provided on a side facing a transfer surface Sa of the sheet S to which the toner image has been transferred, on the downstream side D2 from the nip portion N in the sheet conveyance direction. The discharging device 60 discharges the sheet S to which the toner image has been transferred.

Figure 6A:
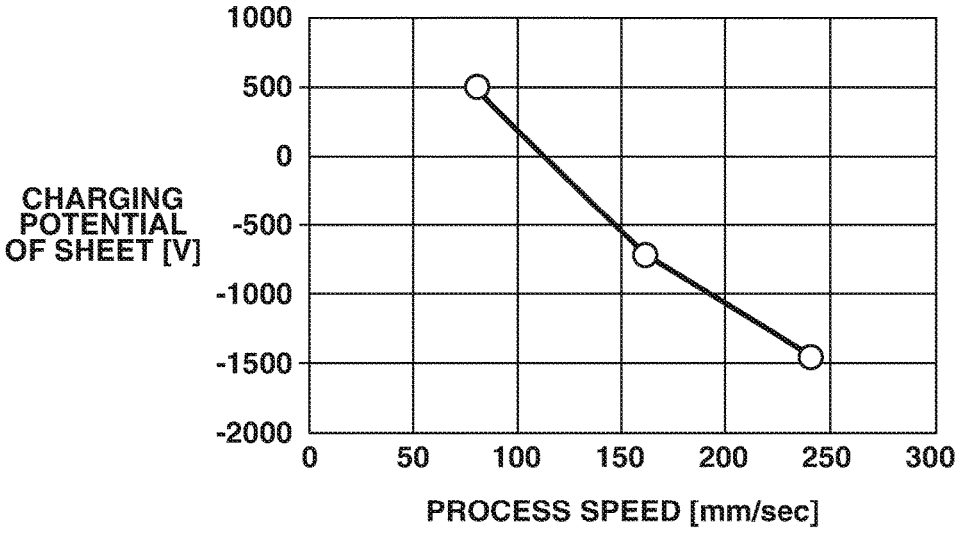
FIG. 6A is a graph illustrating a relationship between a process speed and a sheet charging potential and in the image forming apparatus according to the exemplary embodiment and FIG. 6B is a graph illustrating a relationship between an installation angle of a second discharging plate and a discharging current.

In recent years, for example, multiple steps of process speeds for image formation are sometimes provided in order to cope with a variety of sheets and productivity. In one image forming apparatus, a charging potential of a sheet downstream from the transfer portion with respect to a process speed was measured. A result of the measurement is illustrated in FIG. 6A. As illustrated in FIG. 6A, the result reveled that a charging polarity of a sheet sometimes becomes positive and sometimes becomes negative depending on a process speed. Further, the result revealed that the charging polarity of a sheet changes depending not only on the process speed but also on a resistance value of a sheet and a transfer bias.

Figure 5:
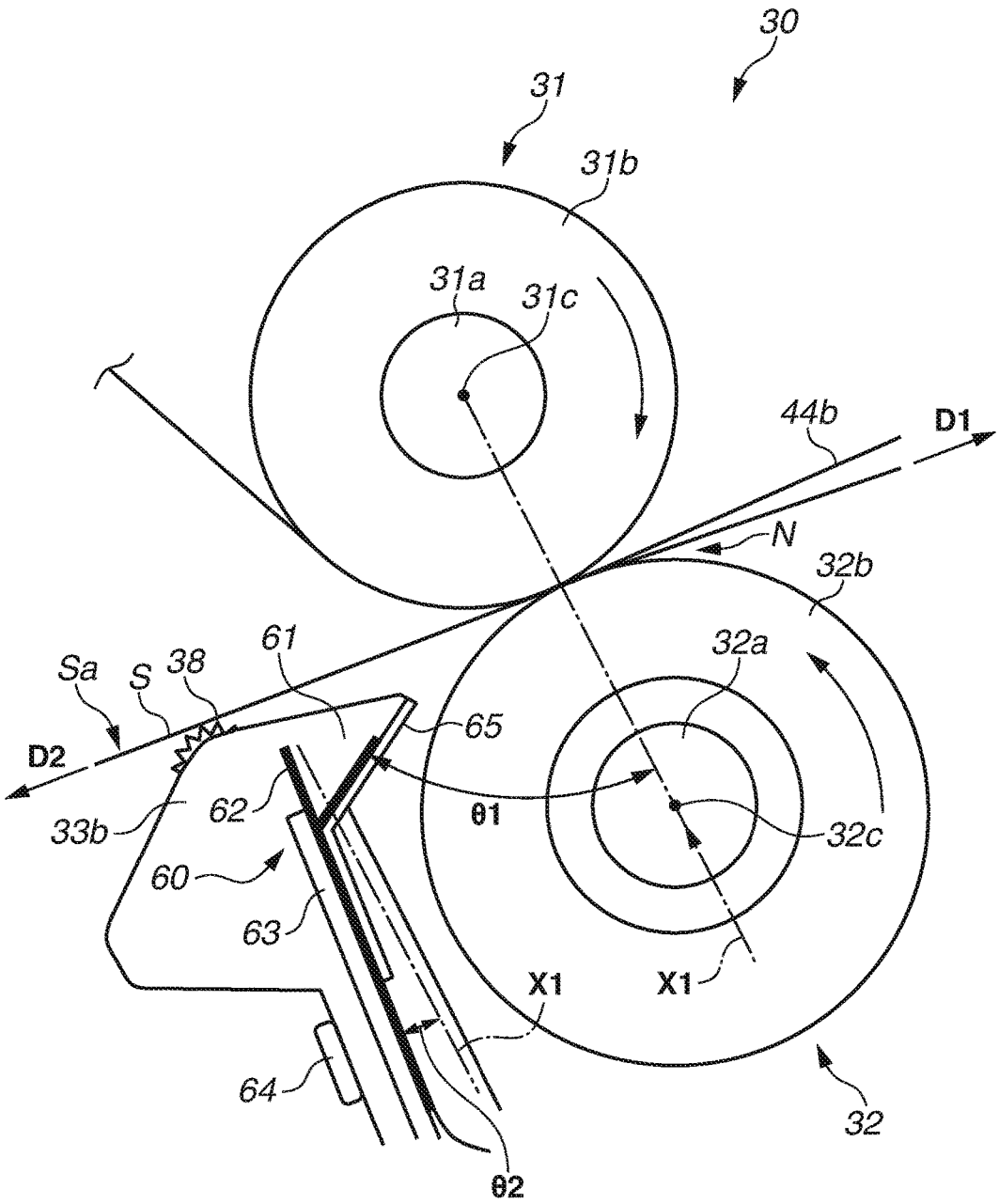
FIG. 5 is a cross-sectional view illustrating a main part of the secondary transfer unit of the image forming apparatus according to the exemplary embodiment.

Therefore, in the present exemplary embodiment, the discharging device 60 includes a first discharging plate (first discharging unit) 61 and a second discharging plate (second discharging unit) 62. The first discharging plate 61 and the second discharging plate 62 are provided so as to be overlapped with each other in parallel with an axial direction of the external secondary transfer roller 32. The second discharging plate 62 is disposed on the downstream side D2 in the sheet conveyance direction with respect to the first discharging plate 61. That is because the effect is produced in either case where the charging polarity of the sheet S is positive or negative. That is, in a case where the charging polarity of the sheet S is positive, the first discharging plate 61 acts on the sheet S, and in a case where the charging polarity of the sheet S is negative, the second discharging plate 62 acts on the sheet S. Further, a study conducted by the inventors of this application revealed that disposition angles of the discharging plates at which efficient discharging is possible differ between cases where the charging polarity of a sheet in secondary transfer is positive and negative. Therefore, in the present exemplary embodiment, an inclined angle is made to be different between the first discharging plate 61 and the second discharging plate 62. As a result, electric charge of the sheet S can be efficiently eliminated in a simple configuration in either case where the charging polarity of the sheet S is positive or negative. That is, the discharging device 60 includes the first discharging plate 61 which is disposed to form a first angle θ1 with respect to a reference plane X1, described below, and the second discharging plate 62 which is disposed to form a second angle θ2 different from the first angle θ1 with respect to the reference plane X1. Both the plates are grounded. In the present exemplary embodiment, an example of the first discharging plate 61 and the second discharging plate 62 having a linear shape in the cross-sectional view of FIG. 5 is described. However, the leading edges of the discharging plates may be bent, for example. In a case where the leading edges of the discharging plates are bent, an angle θ formed by the reference plane X1 and each of the discharging plates is defined as follows: In the cross-sectional view of FIG. 5, the angle θ is formed by a straight line connecting the leading edge of the discharging plate on a sheet conveyance path side and a position 2 mm away from the leading edge toward a base side and the reference plane X1.

The first discharging plate 61 and the second discharging plate 62 are held by a holding plate 63 made of metal, and is fixed by a bolt 64 to the transfer roller holder 33 via the holding plate 63. The first discharging plate 61 and the second discharging plate 62 are connected to a ground potential via the holding plate 63. An insulating sheet (insulating member) 65 is provided between the external secondary transfer roller 32 and the first discharging plate 61. The insulating sheet 65 is, for example, a polyethylene terephthalate (PET) sheet which is an insulating member with a thickness of 0.25 mm. The insulating sheet 65 prevents a high voltage from directly leaking between the external secondary transfer roller 32 and the first discharging plate 61. A leading edge of the first discharging plate 61 and a leading edge of the second discharging plate 62 are configured to be recessed deeper than outlines of the downstream guide ribs 33*b* and the driven rolling members 38. This prevents the first discharging plate 61 and the second discharging plate 62 from contacting with the sheet S.

As illustrated in FIG. 4, the first discharge plate 61 and the second discharging plate 62 are formed by processing a thin plate material, which is made of SUS 304 and has a thickness of 0.1 mm, into a sawtooth shape. A pitch of adjacent sawteeth is, for example, 1 mm. The first discharging plate 61 and the second discharging plate 62 are disposed so that leading edges of the sawteeth face the rear surface of the transfer surface Sa of the sheet S. That is, ends of the first discharging plate 61 and the second discharging plate 62 on a sheet conveyance path side have a shape of a plurality of needles directing the sheet conveyance path.

In a case where the charging polarity of the sheet S in second transfer is positive, in order to improve an ability to be separated from the intermediate transfer belt 44*b*, an electrostatic absorption force for the intermediate transfer belt 44*b* is preferably weakened by eliminating electric charge of the sheet S which has just passed through the nip portion N. Therefore, it is preferable that the first discharging plate 61 is disposed so that the leading edges of the sawteeth face toward the nip portion N from the downstream side of the nip portion N in order to eliminate positive charging. Accordingly, in the present exemplary embodiment, as illustrated in FIG. 5, the first discharging plate 61 is disposed near the nip portion N and forms the first angle θ1 with respect to the reference plane X1. Herein, the reference plane X1 is a plane of the nip portion N orthogonal to the sheet conveyance direction, and this plane includes a center line 32*c* of the external secondary transfer roller 32 and a center line 31*c* of the internal secondary transfer roller 31. The first discharging plate 61 is disposed so that the end on the sheet conveyance path side inclines to face toward the nip portion N with respect to the end on a side opposite to the sheet conveyance path. A plurality of the reference planes X1 illustrated in FIG. 5 are parallel with each other. Formation angles are thus equal to each other between the first discharging plate 61 and the reference plane X1 and between the second discharging plate 62 and the reference plane X1.

The first discharging plate 61 may be disposed so that its discharging leading edge points toward the nip portion N and a transfer current which flows in the external secondary transfer roller 32 and the internal secondary transfer roller 31 does not flow into the first discharging plate 61. In a case where the inclination angle of the first discharging plate 61 with respect to the reference plane X1 exceeds 80°, the transfer current which flows in the external secondary transfer roller 32 and the internal secondary transfer roller 31 might flow into the first discharging plate 61. Further, in a case where the inclination angle of the first discharging plate 61 with respect to the reference plane X1 is less than 40°, the discharging current does not point toward the nip portion N and the sheet S fails to get separated properly. This might stop the operation of the main body. Therefore, in the present exemplary embodiment, the first discharging plate 61 has a flat plate shape and the first angle θ1 is in a range between 40° and 80° inclusive, particularly the first angle θ1 is 60°.

Figure 6B:
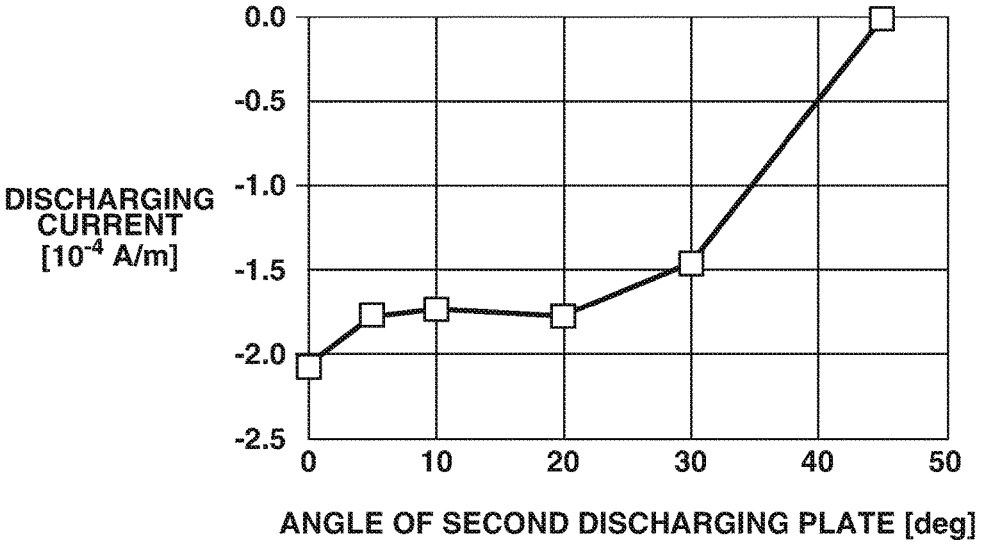

On the other hand, an operation was performed on an angle between a normal to the sheet S and the second discharging plate 62 under conditions that the second discharging plate 62 was grounded and a surface potential of the sheet S was −3300 V. A relationship between the angle and a discharging current obtained as an output was calculated as an evaluation index. The result is illustrated in FIG. 6B. FIG. 6B illustrated that, in a case where the direction of the second discharging plate 62 with respect to the sheet S was within 30° with respect to the normal to the sheet S, a satisfactory result could be obtained.

In a case where the charging polarity of the sheet S in secondary transfer is negative, in order to efficiently eliminate electric charge of the sheet S, the second discharging plate 62 is disposed at a second angle θ2 with the reference plane X1 in the present exemplary embodiment, as illustrated in FIG. 5. The second angle θ2 is different from the first angle θ1. The second angle θ2 is smaller than the first angle θ1. It is preferable that the second discharging plate 62 has a flat plate shape and the second angle θ2 is in a range of 30° or less.

Upper and lower limits of the second angle θ2 are ±30°, and if exceeding this value, as illustrated in FIG. 6B, the discharging effect is likely to be sharply weakened or disappear. Therefore, in the present exemplary embodiment, the second angle θ2 is set to 5°. The angle between the second discharging plate 62 and the sheet S might change depending on a type of the sheet or the like. Further, an effect is produced if the second angle θ2 is within 30° with respect to the normal to the sheet S. Therefore, definition can be clarified regardless of a type of the sheet by setting the second angle θ2 as the angle with respect to the reference plane X1.

Figure 7:
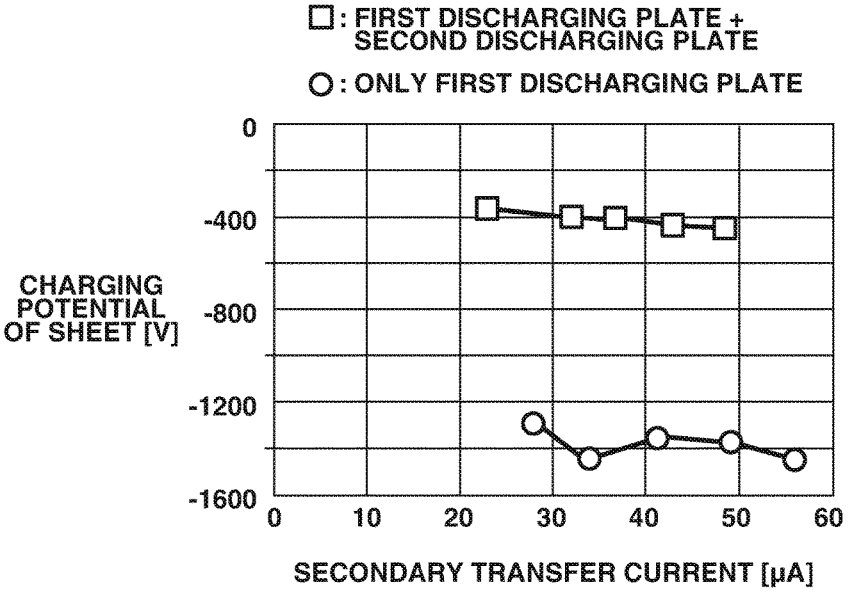
FIG. 7 is a graph illustrating a relationship between a secondary transfer current and the sheet charging potential in the image forming apparatus according to the exemplary embodiment.

Herein, a relationship between the charging potential of the sheet with respect to a secondary transfer current was compared between a case where only the first discharging plate 61 was disposed and a case where the first discharging plate 61 and the second discharging plate 62 were disposed. The result is illustrated in FIG. 7. As illustrated in FIG. 7, in a case where the charging polarity of the sheet S was negative and only the first discharging plate 61 was disposed, the discharging could not be efficiently performed. That is, at the installation angle of the first discharging plate 61, negative charging could not be efficiently removed. On the contrary, in the case where the first discharging plate 61 and the second discharging plate 62 were disposed like the image forming apparatus 1 according to the present exemplary embodiment, negative charging could be efficiently eliminated. That is, it was found that an ability to eliminate the negative charging of the second discharging plate 62 was high.

An operation of the secondary transfer unit 30 in the image forming apparatus 1 according to the present exemplary embodiment will be described below. In an image forming step, in a case where the sheet S is conveyed to the secondary transfer unit 30, the secondary transfer power source 37 applies a secondary transfer bias to the external secondary transfer roller 32. As a result, in the nip portion N, a toner image formed on the intermediate transfer belt 44*b* is transferred to the sheet S. The sheet S which has passed through the nip portion N is positively or negatively charged. In a case where the charging polarity of the sheet S is positive, the sheet S is discharged by the first discharging plate 61. The sheet S is thus easily separated from the intermediate transfer belt 44*b*. Further, since the sheet S is discharged before approaching the second discharging plate 62, the sheet S is not discharged by the second discharging plate 62. On the other hand, in a case where the charging polarity of the sheet S is negative, the sheet S passes through the first discharging plate 61 without being discharged, and is discharged by the second discharging plate 62.

As described above, in the image forming apparatus 1 according to the present exemplary embodiment, since the first discharging plate 61 and the second discharging plate 62 are grounded and the disposition angles are different, one discharging unit can eliminate positive charging and the other discharging unit can eliminate the negative charging. Further, since the first discharging plate 61 is disposed near the nip portion N, it can discharge the sheet S which has just passed through the nip portion N. As a result, while the ability of the sheet S to be separated from the intermediate transfer belt 44*b* is maintained, discharging can be performed in any of the cases where the charging property of the sheet S obtained by secondary transfer is positive and negative. Therefore, image fluctuation caused by insufficient discharging can be suppressed. Further, since both the first discharging plate 61 and the second discharging plate 62, are made of one flat plate, each configuration is simple. Thus, an increase in a cost can be suppressed.

Figure 8A:
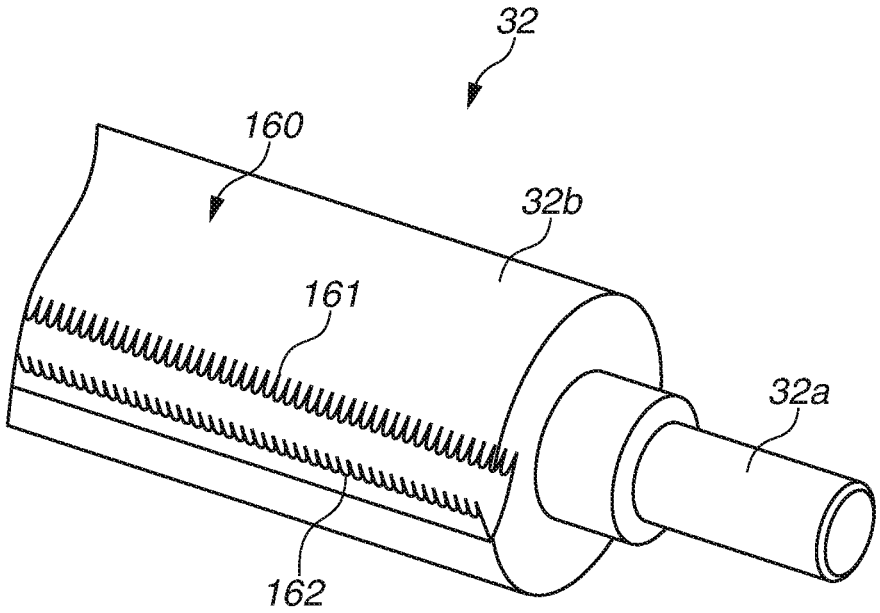
FIG. 8A is a perspective view illustrating an exemplary modification of a discharging device and FIG. 8B is a perspective view illustrating another exemplary modification, in the image forming apparatus according to the exemplary embodiment.

In the image forming apparatus 1 according to the present exemplary embodiment, the first discharging plate 61 and the second discharging plate 62 are made of separate members, but the configuration of these discharging plates is not limited to this. For example, as illustrated in FIG. 8A, a first discharging plate 161 and a second discharging plate 162 of a discharging device 160 may be configured by bending one thin-plate member. That is, since both the first discharging plate 161 and the second discharging plate 162 are a ground potential, they may be made of one thin plate. The first discharging plate 161 and the second discharging plate 162 made of one plate member are bonded to the holding plate 63 (see FIG. 2) to be supported. In this case, a number of parts can be made to be smaller than a case where the first discharging plate and the second discharging plate are separated from each other.

Figure 8B:
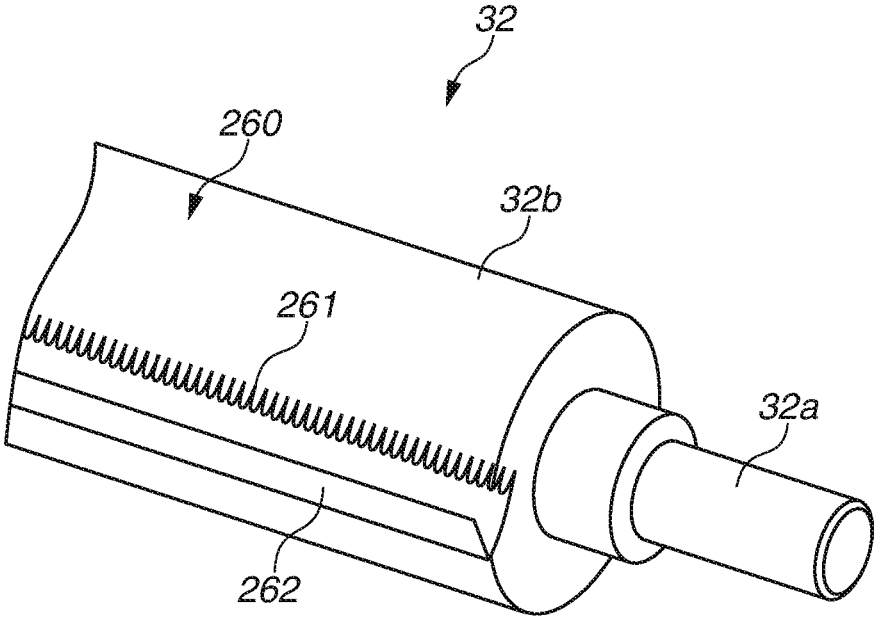

Further, in the above-described image forming apparatus 1 according to the present exemplary embodiment, the ends of the first discharging plate 61 and the second discharging plate 62 on the sheet conveyance path side have a plurality of needle-shaped portions which point toward the sheet conveyance path, but the discharging plates are not limited to this shape. For example, as illustrated in FIG. 8B, an end of at least one of a first discharging plate 261 and a second discharging plate 262 of a discharging device 260 may have a linear shape which points toward the sheet conveyance path. That is, only the first discharging plate 261 may have a linear shape, only the second discharging plate 262 may have a linear shape, or both the first discharging plate 261 and the second discharging plate 262 may have a linear shape. In any cases, in a case where the charging polarity of the sheet S is positive, the first discharging plate 261 acts on the sheet S, and in a case where the charging polarity of the sheet S is negative, the second discharging plate 262 acts on the sheet S. Therefore, the first discharging plate 261 and second discharging plate 262 produce an effect similar to the effect of the first discharging plate 61 and the second discharging plate 62 according to the above-described exemplary embodiment.

Figure 9A:
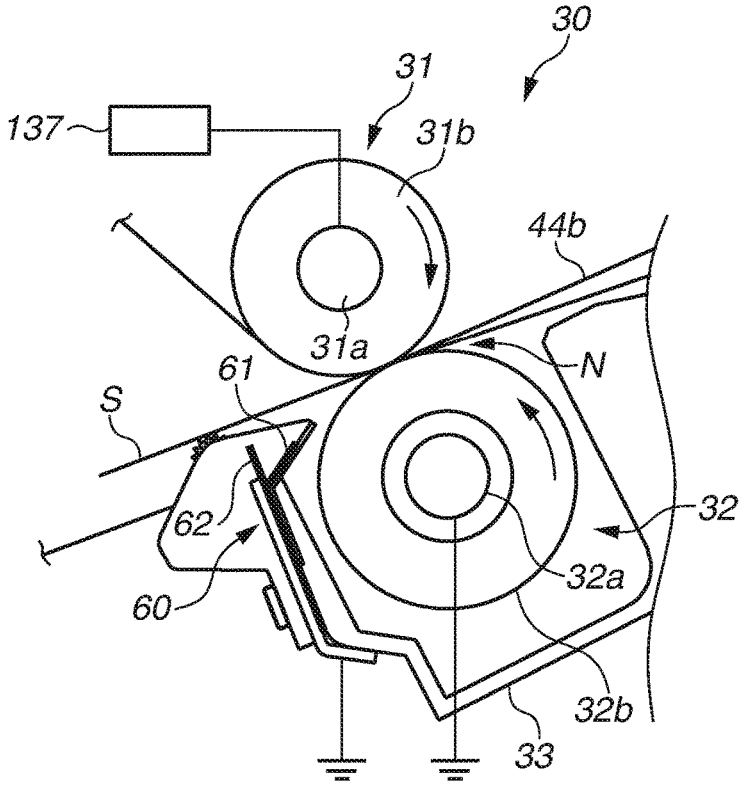
FIG. 9A is a cross-sectional view illustrating an exemplary modification of a secondary transfer power source and FIG. 9B is a cross-sectional view illustrating another exemplary modification of the secondary transfer power source, in the image forming apparatus according to the exemplary embodiment.
Figure 9B:
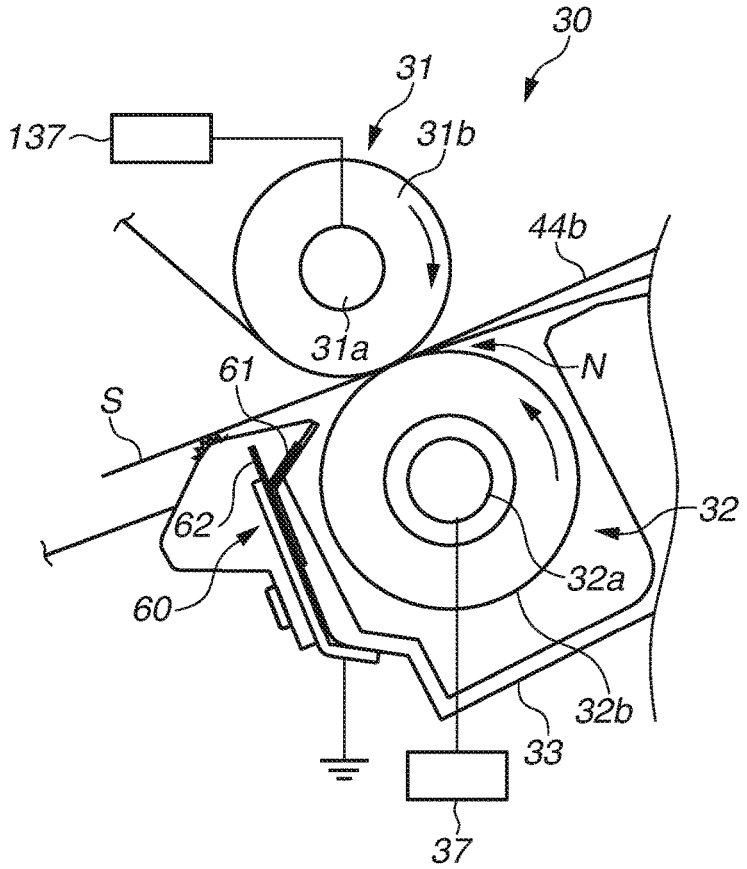

Further, in the image forming apparatus 1 according to the present exemplary embodiment, a secondary transfer bias is applied from the secondary transfer power source 37 which is connected to the external secondary transfer roller 32, but the application is not limited to this. For example, as illustrated in FIG. 9A, a secondary transfer bias may be applied from a secondary transfer power source 137 connected to the internal secondary transfer roller 31. Alternatively, as illustrated in FIG. 9B, a secondary transfer bias may be applied from the secondary transfer power source 37 connected to the external secondary transfer roller 32 and the secondary transfer power source 137 connected to the internal secondary transfer roller 31. In any cases, the effect similar to the effect in the above-described exemplary embodiment can be produced.

Further, in the image forming apparatus 1 according to the present exemplary embodiment, negatively charged toner is used as the toner, but the toner is not limited to this, and positively charged toner may be used.

Since the first discharging unit and the second discharging unit are grounded and the disposition angles are different, one discharging unit can eliminate positive charging and the other discharging unit can eliminate negative charging. Further, since the first discharging unit is disposed near the nip portion, a sheet which has just passed through the nip portion can be discharged. Therefore, while the ability of a sheet to be separated from an image carrier is maintained, discharging can be performed in any of the cases where the charging property of the sheet obtained by transfer is positive and negative. Therefore, image fluctuation caused by insufficient discharging can be suppressed.

While exemplary embodiments have been described, it is to be understood that aspects of the present disclosure are not limited to the disclosed exemplary embodiments. The scope of the following claims is to be accorded the broadest interpretation so as to encompass all such modifications and equivalent structures and functions.

This application claims the benefit of Japanese Patent Application No. 2017-019916, filed Feb. 6, 2017, which is hereby incorporated by reference herein in its entirety.

What is claimed is:

1. An image forming apparatus comprising:

an intermediate transfer belt configured to carry a toner image;

a first transfer roller being in contact with an outer circumferential surface of the intermediate transfer belt and configured to transfer the toner image carried by the intermediate transfer belt to a recording medium at a transfer portion;

a second transfer roller being in contact with an inner circumferential surface of the intermediate transfer belt and configured to form the transfer portion; and a discharging device being disposed downstream from the transfer portion in a recording medium conveyance direction and configured to discharge an electric charge of a surface of the recording medium while the recording medium passes through the transfer portion, the surface of the recording medium being opposite to a surface on which the toner image is transferred, wherein the discharging device includes a first discharging unit configured to discharge the recording medium, the first discharging unit being disposed and extending in a widthwise direction orthogonal to the recording medium conveyance direction, a second discharging unit configured to discharge the recording medium, the second discharging unit being disposed downstream from the first discharging unit in the recording medium conveyance direction and extending in the widthwise direction orthogonal to the recording medium conveyance direction, and a regulating unit configured to regulate contact of the recording medium with leading edges of the first and second discharging units, the regulating unit protruding toward the recording medium conveyance path to exceed the leading edges of the first and second discharging units, wherein the first discharging unit is disposed so that the leading edge thereof close to the recording medium conveyance path faces upstream in the recording medium conveyance direction, and in a cross section orthogonal to a rotational axis of the first transfer roller, an angle between a reference line and the first discharging unit is in a range from 40° or more to 80° or less and an angle between the reference line and the second discharging unit is in a range of 30° or less, the reference line connecting a rotational center of the first transfer roller and a rotational center of the second transfer roller, and wherein both the first discharging unit and the second discharging unit are mounted so as to be grounded.

2. The image forming apparatus according to claim 1, wherein the first discharging unit and the second discharging unit are held by one metal member.

3. The image forming apparatus according to claim 2, further comprising a holder configured to support the first transfer roller, wherein the metal member is fixed to the holder.

4. The image forming apparatus according to claim 3, wherein the regulating unit is formed integrally with the holder and is a plurality of guide ribs that is arranged in a direction crossing the recording medium conveyance direction and guides the recording medium.

5. The image forming apparatus according to claim 1, wherein at least one of the first discharging unit and the second discharging unit includes an end having a plurality of needle-shaped portions, the end being close to the recording medium conveyance path.

6. The image forming apparatus according to claim 1, further comprising an insulating sheet disposed between the first discharging unit and the first transfer roller, and a leading edge of the insulating sheet protrudes toward the recording medium conveyance path more than the leading edge of the first discharging unit.

* * * * *